US008693918B2

(12) United States Patent
Hoshino

(10) Patent No.: US 8,693,918 B2
(45) Date of Patent: Apr. 8, 2014

(54) IMAGE FORMING APPARATUS HAVING MECHANISM FOR PLACING FIXING UNIT IN NIP RELAXED STATE

(71) Applicant: Brother Kogyo Kabushiki Kaisha, Aichi (JP)

(72) Inventor: Takashi Hoshino, Aichi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 13/942,788

(22) Filed: Jul. 16, 2013

(65) Prior Publication Data

US 2013/0308974 A1 Nov. 21, 2013

Related U.S. Application Data

(63) Continuation of application No. 13/049,121, filed on Mar. 16, 2011, now Pat. No. 8,509,654.

(30) Foreign Application Priority Data

Sep. 30, 2010 (JP) ..... 2010-220564
Feb. 22, 2011 (JP) ..... 2011-035487

(51) Int. Cl.
*G03G 15/16* (2006.01)

(52) U.S. Cl.
USPC ..... 399/122

(58) Field of Classification Search
USPC ..... 399/107, 110, 122, 124, 320, 328; 219/216
See application file for complete search history.

(56) References Cited

U.S. PATENT DOCUMENTS 6,678,481 B2 1/2004 Sawanaka et al.
6,904,257 B2 6/2005 Tomatsu
7,263,311 B2 8/2007 Ikeda
7,885,562 B2 2/2011 Wang et al.

(Continued)

FOREIGN PATENT DOCUMENTS

JP 4-112272 U 9/1992
JP 05-100548 B2 4/1993

(Continued)

OTHER PUBLICATIONS

JP Office Action dtd Jan. 22, 2013, JP Appln. 2011-035487, English translation.

(Continued)

*Primary Examiner* — Robert Beatty
(74) *Attorney, Agent, or Firm* — Banner & Witcoff, Ltd.

(57) ABSTRACT

An image forming apparatus is provided. The image forming apparatus includes an image forming unit, a door to cover an opening in a chassis, a fixing unit, a frame, a linear motion member to linearly move along with the door, a guiding member to guide the linear motion member to move linearly, a coupler assembly to couple the door with the linear motion member and move the linear motion member, and a manipulation member being movable according to movement of the linear motion member. The linear motion member includes a contact portion, with which the manipulation member comes in contact along an intersecting direction. The guiding member includes a slider plane to slidably support the linear motion member. The linear motion member is slidably supported by the slider plane of the guiding member at a surface which is on an opposite side from the surface having the contact portion.

29 Claims, 13 Drawing Sheets

(56) References Cited

U.S. PATENT DOCUMENTS

| | | | |
|---|---|---|---|
| 7,953,348 | B2 | 5/2011 | Chang et al. |
| 7,974,553 | B2 | 7/2011 | Matsuo et al. |
| 8,023,861 | B2 | 9/2011 | Yoshinaga et al. |
| 2002/0114633 | A1 | 8/2002 | Sawanaka et al. |
| 2009/0190958 | A1 | 7/2009 | Wang et al. |
| 2010/0028044 | A1 | 2/2010 | Matsuo et al. |
| 2012/0219324 | A1 | 8/2012 | Masuda |

FOREIGN PATENT DOCUMENTS

| | | | | |
|---|---|---|---|---|
| JP | 05-281795 | A | | 10/1993 |
| JP | 7-302007 | A | | 11/1995 |
| JP | 8-254913 | A | | 10/1996 |
| JP | 09274421 | A | * | 10/1997 |
| JP | 10-207320 | A | | 8/1998 |
| JP | 2001-166627 | A | | 6/2001 |
| JP | 2002-148992 | A | | 5/2002 |
| JP | 2002-234230 | A | | 8/2002 |
| JP | 2003-167469 | A | | 6/2003 |
| JP | 2003-287973 | A | | 10/2003 |
| JP | 2005-043659 | A | | 2/2005 |
| JP | 2006-099003 | A | | 4/2006 |
| JP | 2007-079488 | A | | 3/2007 |
| JP | 2009-180918 | A | | 8/2009 |
| JP | 2010-032833 | A | | 2/2010 |
| JP | 2010-038952 | A | | 2/2010 |
| JP | 2010-091598 | A | | 4/2010 |

OTHER PUBLICATIONS

Notice of Allowance issued in corresponding U.S. Appl. No. 13/049,121 mailed Apr. 5, 2013.

Search Report and Search Opinion issued in corresponding European Application No. 11002152.4, mailed Oct. 11, 2013.

* cited by examiner

IMAGE FORMING APPARATUS HAVING MECHANISM FOR PLACING FIXING UNIT IN NIP RELAXED STATE

CROSS REFERENCE TO RELATED APPLICATION

This application is a continuation of U.S. application Ser. No. 13/049,121, filed on Mar. 16, 2011, which claims priority from Japanese Patent Application No. 2010-220564, filed on Sep. 30, 2010, and Japanese Patent Application No 2011-035487, filed on Feb. 22, 2011, the entire subject matters of which are incorporated herein by reference.

BACKGROUND

1. Technical Field

An aspect of the present invention relates to an image forming apparatus having a nip-relaxing mechanism, which can clear or relax a nipping condition in a fixing unit in cooperation of an opening motion of a cover of a chassis.

2. Related Art

An image forming apparatus to form an image in toner in an electrophotographic method is often provided with a fixing unit, which fixes the toner image transferred onto a recording sheet thereat by, for example, pressure and heat. The fixing unit includes a heating member (e.g., a heat roller) and a pressing member (e.g., a pressure roller), which are arranged to be in close contact with each other and in opposing positions from each other to nip the recording sheet there-between. When the recording sheet passes through the nipped section between the heating member and the pressing member, the image on the recording sheet is fixed thereat by the pressure and the heat.

Whilst the recording sheet passes through the narrow nipping section, in which the heating member and the pressing member are in close contact with each other, the recording sheet may jam in the section between the heating member and the pressing member in various reasons. When the jammed sheet is removed, therefore, the heating member and the pressing member need to be separated from each other in order to release the sheet. For easier removal of the jammed sheet, an image forming apparatus may be equipped with a mechanism to separate the heating member and the pressing member from each other in cooperation with an opening motion of a cover of the image forming apparatus (see FIG. 13).

The image forming apparatus shown in FIG. 13 is provided with a nip-relaxing member 210, which is connected to the pressing member in the fixing unit, and a connector rod 220, which connects the nip-relaxing member 210 to the top cover 220. When the top cover 200 is opened and closed, the nip-relaxing member 210 is shifted upward and downward in cooperation with the top cover 200 to switch a nipping condition and nip-relaxed condition in the fixing unit. The nip-relaxing member 210 is formed to have a groove 211, in which a shaft 212 in the connector rod 220 is slidably movable.

When the top cover 200 is in the open position, as indicated by a dotted line in FIG. 13, the top cover 200 uplifts the connector rod 220 whilst the connector rod 220 rotates about the shaft 212. Accordingly, the nip-relaxing member 210 is shifted upwardly to clear the nipping condition in the fixing unit. When the top cover 200 is in the closed position, as indicated by a solid line in FIG. 13, the connector rod 220 is rotated about the shaft 212 downwardly. Accordingly, the nip-relaxing member 210 is lowered to place the fixing unit in the nipping condition.

SUMMARY

In order to have the connector rod 220 rotatable in an arc according to the opening/closing motions of the top cover 200, the image forming apparatus is required to have internal space, in which the connector rod 220 is movable, in the body thereof. Further, the shaft 212 and the groove 211 are required to be substantially rigid to bear nipping load applied by the connector rod 220 and to be smoothly movable at the same time.

In view of the above difficulties, the present invention is advantageous in that an image forming apparatus, which is smaller in size of a nip-relaxing mechanism in a fixing unit, and in which nipping condition in the fixing unit can be smoothly cleared, is provided.

According to an aspect of the present invention, an image forming apparatus is provided. The image forming apparatus includes a chassis having an opening, an image forming unit, which is configured to form a toner image on a recording medium, a door, which is disposed at the opening of the chassis and configured to be movable in a range between an open position and a closed position with respect to the chassis of the image forming apparatus, a fixing unit, which is configured to nip the recording sheet with the toner image formed thereon by nipping pressure and fix the toner image on the recording sheet, a frame, which is arranged inside the chassis and extend along a direction of a line connecting the door and the fixing unit, a linear motion member, which extends along the line connecting the door and the fixing unit, a guiding member, which is formed in the frame and configured to guide the linear motion member to move linearly in a motion path along the line connecting the door and the fixing unit, a coupler assembly, which is configured to couple the door with the linear motion member and move the linear motion member in the motion path according to opening and closing motions of the door, and a manipulation member, which is movable according to the linear motion of the linear motion member and is configured to place the fixing unit in one of a nipping condition, in which the recording sheet is nipped by the nipping pressure in the fixing unit, and a nip-relaxed condition, in which nipping pressure is relaxed in the fixing unit. The linear motion member includes have a contact portion, with which the manipulation member comes in contact along an intersecting direction to intersect the motion path of the linear motion member when the linear motion member moves the manipulation member, on a surface thereof. The guiding member includes a slider plane to slidably support the linear motion member and to bear reaction force from the manipulation member. The linear motion member is slidably supported by the slider plane of the guiding member at a surface which is on an opposite side from the surface having the contact portion.

According to another aspect of the present invention, an image forming apparatus is provided. The image forming apparatus includes an image forming unit, which is configured to form a toner image on a recording medium, a fixing unit, which is configured to nip the recording sheet with the toner image by nipping pressure and fix the toner image on the recording sheet, frames including a first frame and a second frame, which are arranged to have the image forming unit and the fixing unit in internal space there-between, a door, which is configured to cover an opening, the opening being connected with one side of the internal space between the first frame and the second frame, the one side being an opposite side from the fixing unit across the image forming unit, a linear motion member, which is configured to extend along the line connecting the door and the fixing unit, a guiding member, which is formed in the first frame and configured to guide the linear motion member to move linearly in a motion path along the line connecting the door and the fixing unit, a coupler assembly, which is configured to couple the door with the linear motion member and move the linear motion member in the motion path in cooperation with opening and closing motions of the door, and a manipulation member, which is configured to place the fixing unit in one of a nipping condition, in which the recording sheet is nipped by the nipping pressure in the fixing unit, and a nip-relaxed condition, in which nipping pressure is relaxed in the fixing unit. The manipulation member is configured to be rotatable about an axis, which is in a position vertically separated from a motion path of the linear motion member, and extends from the axis to be reachable to intersect with the motion path. The linear motion member includes a contact portion, with which the manipulation member comes in contact along an intersecting direction to intersect the motion path of the linear motion member when the linear motion member moves the manipulation member, on a surface thereof. The guiding member includes a slider plane to slidably support the linear motion member and to bear reaction force from the manipulation member. The linear motion member is slidably supported by the slider plane of the guiding member at a surface which is on an opposite side from the surface having the contact portion.

BRIEF DESCRIPTION OF THE ACCOMPANYING DRAWINGS

DETAILED DESCRIPTION

Overall Configuration of the MFP

Figure 1:
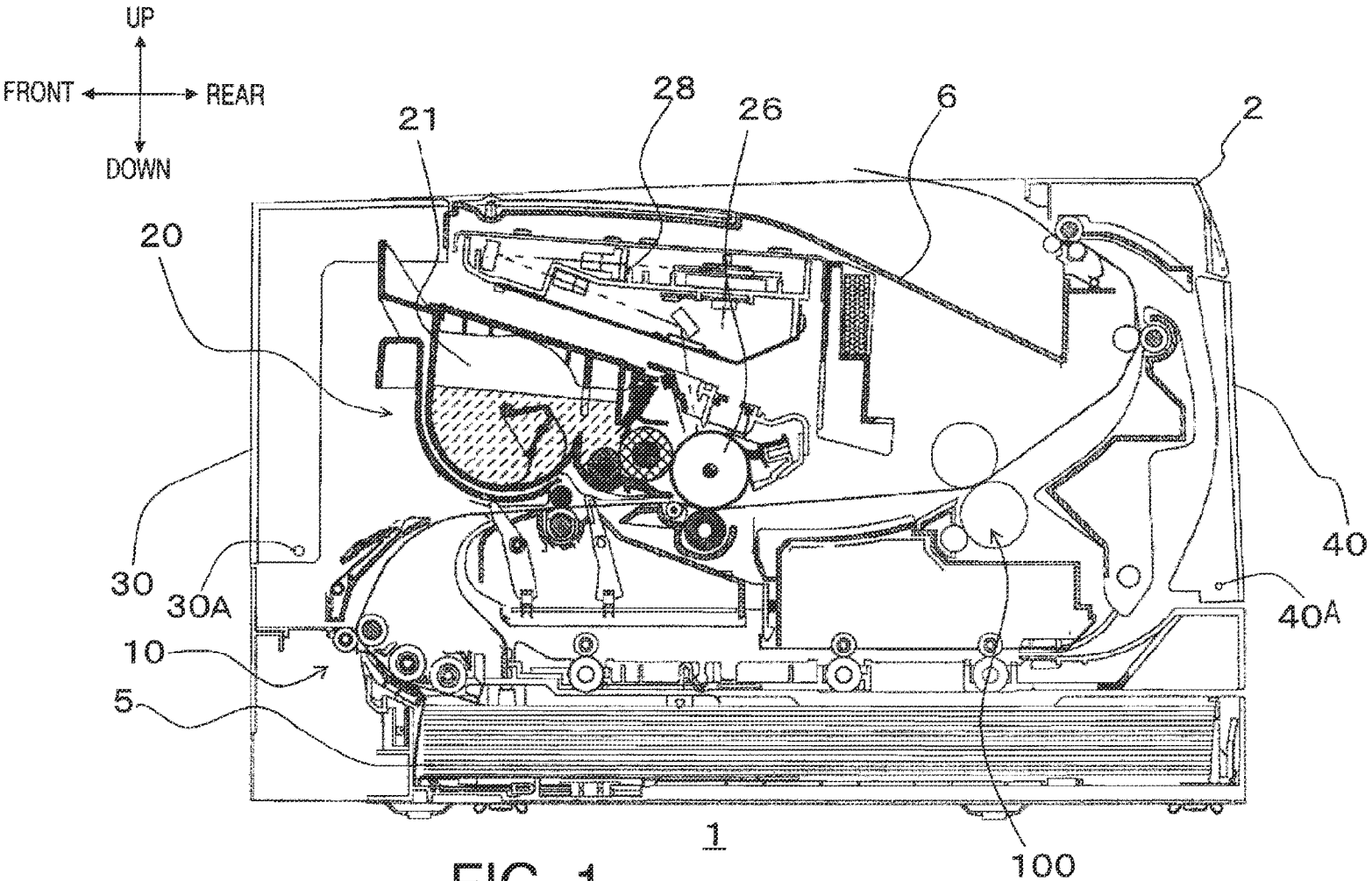
FIG. 1 is a cross-sectional side view of a printer according to an embodiment of the present invention.

Hereinafter, embodiments of the present invention will be described with reference to the accompanying drawings. The printer 1 is an image forming apparatus to form an image on a recording sheet, having a sheet-feed tray 5, a sheet conveyer 10, an image forming unit 20, a fixing unit 100, and a discharge tray 6. Recording sheets stored in the sheet-feed tray 5 are picked up one-by-one by the sheet conveyer 10 and conveyed to the image forming unit 20, in which a toner image is formed and transferred onto the recording sheet. The recording sheet with the transferred toner image is further carried to the fixing unit 100, in which the toner image is fixed on the recording sheet, and ejected out of the printer 1. The ejected recording sheet is settled in the discharge tray 6.

In the description below, directions concerning the printer 1 will be referred to based on a user's position to use the printer 1. That is, a viewer's left-hand side appearing in FIG. 1 is referred to as a front face of the printer 1, and right-hand side in FIG. 1 opposite from the front side is referred to as rear. A side which corresponds to the viewer's nearer side is referred to as right, and an opposite side from the right, which corresponds to the viewer's further side, is referred to as left. The up-down direction in FIG. 1 corresponds to a vertical direction of the printer 1. Further, the vertical direction of the printer 1 may be referred to as a direction of height, the right-left direction of the printer 1 may be referred to as a widthwise direction, and the front-rear direction may be referred to as a direction of depth. The direction of height, the widthwise direction, and the direction of depth are perpendicular to one another.

Figure 4:
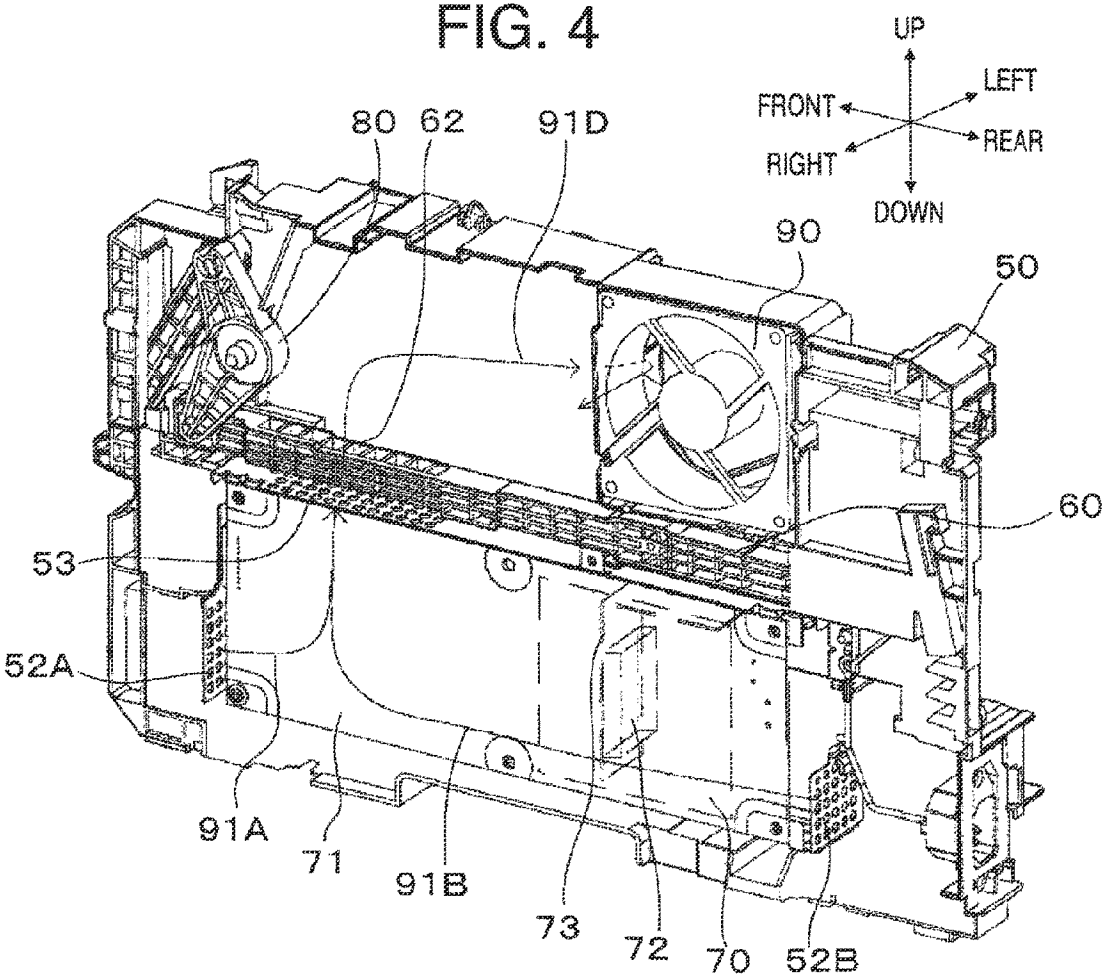
FIG. 4 is a perspective view of an outer side of a main frame of the printer according to the embodiment of the present invention.

The printer 1 includes a pair of main frames 50, as solely a right-side one of the main frames 50 is shown in FIG. 4. The sheet-feed tray 5, the sheet conveyer 10, the image forming unit 20 and the fixing unit 100 are arranged in internal space between the main frames 50. Each of the main frames 50 is a plate having smaller width in the right-left direction and extends vertically in the up-down direction and along the direction of depth, which is in parallel with a line connecting the front door 30 and the fixing unit 100, in the printer 1. The pair of main frames 50 are connected with each other via beams (not shown), which extend perpendicularly to the main frames 50. Further, the main frames 50 are covered by a main casing 2 being an external covering.

The internal space between the main frames 50 can be exposed to be accessed by a user through openings on the front side and the rear side of the printer 1. The front and rear openings are covered by a front door 30 and a rear door 40 respectively. The front door 30 and the rear door 40 are rotatable about a shaft 30A and a shaft 40A respectively, which are on lower ends of the front door 30 and the rear door 40, to be openable and closable with respect to the main casing 2.

The image forming unit 20 includes a processing cartridge 21, which has a toner container (unsigned) and a photosensitive drum 26. The processing cartridge 21 is removably installed in the internal space between the main frames 50 through the front opening when the front door 30 is open.

The photosensitive drum 26 is exposed to light emitted from an exposure unit 28, and an area exposed to the light forms a latent image. As the photosensitive drum 26 rotates, toner is supplied to the latent image, and a toner image is developed on a surface of the photosensitive drum 26. The toner image is transferred onto the recording sheet having been conveyed as the photosensitive drum 26 further rotates. The recording sheet with the transferred toner image is fixed thereat by pressure and heat in the fixing unit 100, which is arranged in a rear position in the printer 1 with respect to the image forming unit 20, and ejected to be settled on the discharge tray 6.

Configuration of Fixing Unit

Figure 2:
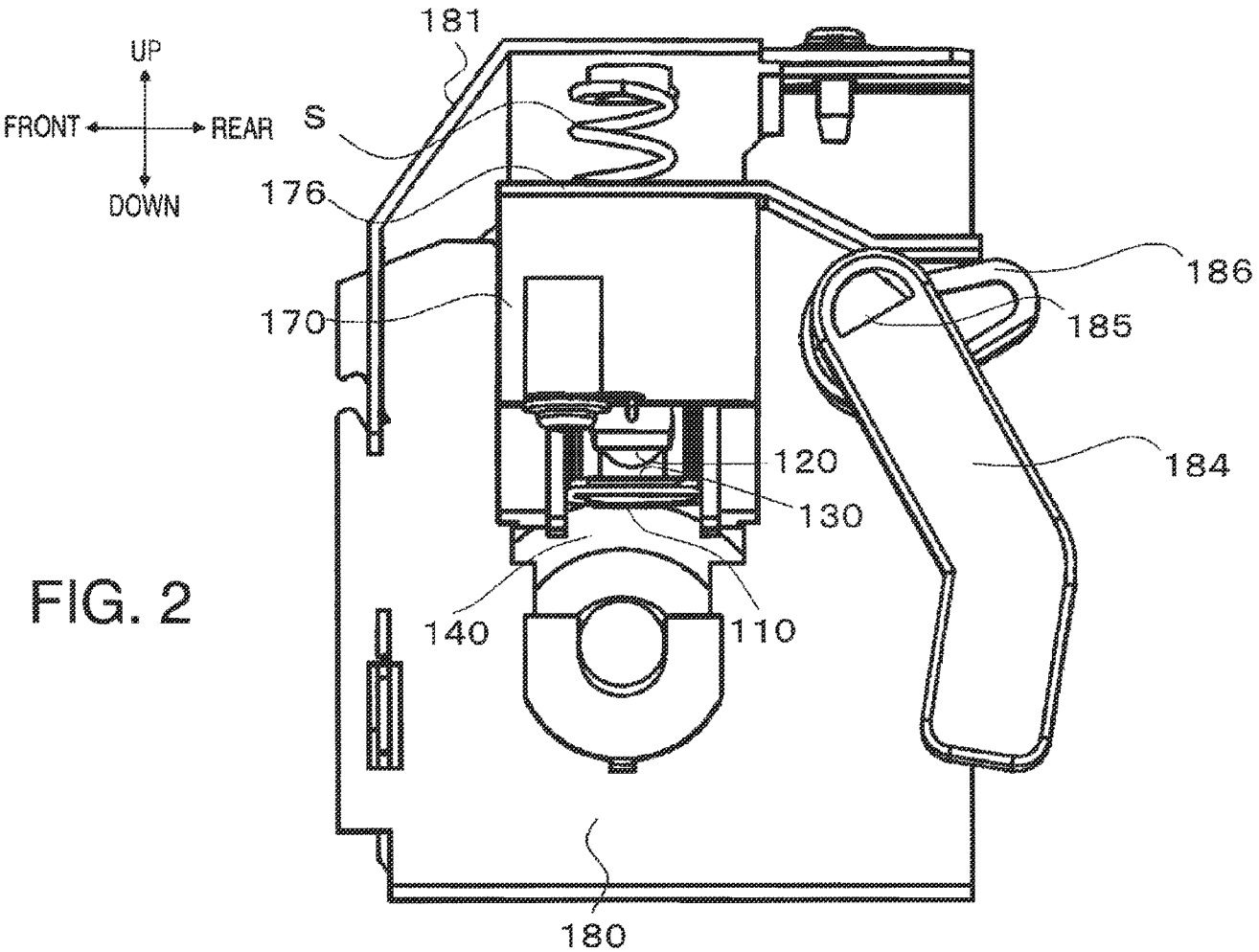
FIG. 2 is a right side view of a fixing unit in nipping condition in the printer according to the embodiment of the present invention.

The fixing unit 100 may have, for example, a known thermal fixing device having a heat roller with a heat source and a pressure roller pressed against the heat roller or may have an endless fixing film instead of a heat roller. In the present embodiment, as shown in FIG. 2, the fixing unit 100 has an endless fixing film 110 and a pressure roller 140, which are in opposing positions from each other. Further, a halogen lamp 120 being a heat source and a nipping plate 130, which are arranged in an opposite position from the pressure roller 140 across the fixing film 110, are included. The nipping plate 130 is pressed against the pressure roller 140 via the fixing film 110 (and the recording sheet). As the pressure roller 140 rotates, the recording sheet nipped between the pressure roller 140 and the fixing film 110 is conveyed, and the fixing film 110 is rotated. In this regard, the toner image having been transferred onto the recording sheet is fused and fixed thereon.

The pressure roller 140 extends perpendicularly with respect to a pair of smaller frames 180 (solely one on the right is shown in FIG. 2) in the fixing unit 100 and is rotatably supported by the smaller frames 180. The fixing film 110, the halogen lamp 120, and the nipping plate 130 are supported by a pair of guide plates 170 (solely one on the right is shown in FIG. 2), which are supported vertically movably by the smaller frames 180. In other words, the guide plates 170 are movable along a direction, in which the nipping plate 130 is movable with respect to the pressure roller 140.

Each of the smaller frames 180 includes an upper frame 181, which extends above the guide plate 170. In the space between the upper frame 181 and the guide plate 170, a spring S to apply downward pressure to the guide plate 170 is interposed so that the nipping plate 130 is urged against the pressure roller 140 by urging force of the expanding spring S, and nipping pressure is generated in the section between the nipping plate 130 and the pressure roller 140.

The fixing unit 100 further includes a rotation shaft 185, which extends perpendicularly with respect to the smaller frames 180 to be supported thereby. The rotation shaft 185 has a cam 186 on each lateral end (i.e., right and left ends) of the rotation shaft 185. The cam 186 is integrally fixed to the rotation shaft 185 and formed to partially and eccentrically protrude outwardly in a radial direction. The cam 186 is in a lower rear position with respect to a stepped plate 176, which is fixed to top ends of the guide plates 170 and extends rearwardly from the guide plates 170. The stepped plate 176 is bended to extend lower at a rear part thereof, and the cam 186 is in a lower position with respect to the lower rear part of the stepped plate 176. The rotation shaft 185 is further provided with a manipulation lever 184, which manipulates the nipping pressure in the fixing unit 100. The manipulation lever 184 is integrally fixed to one of the lateral ends (e.g., right-side end) of the rotation shaft 185.

Figure 3:
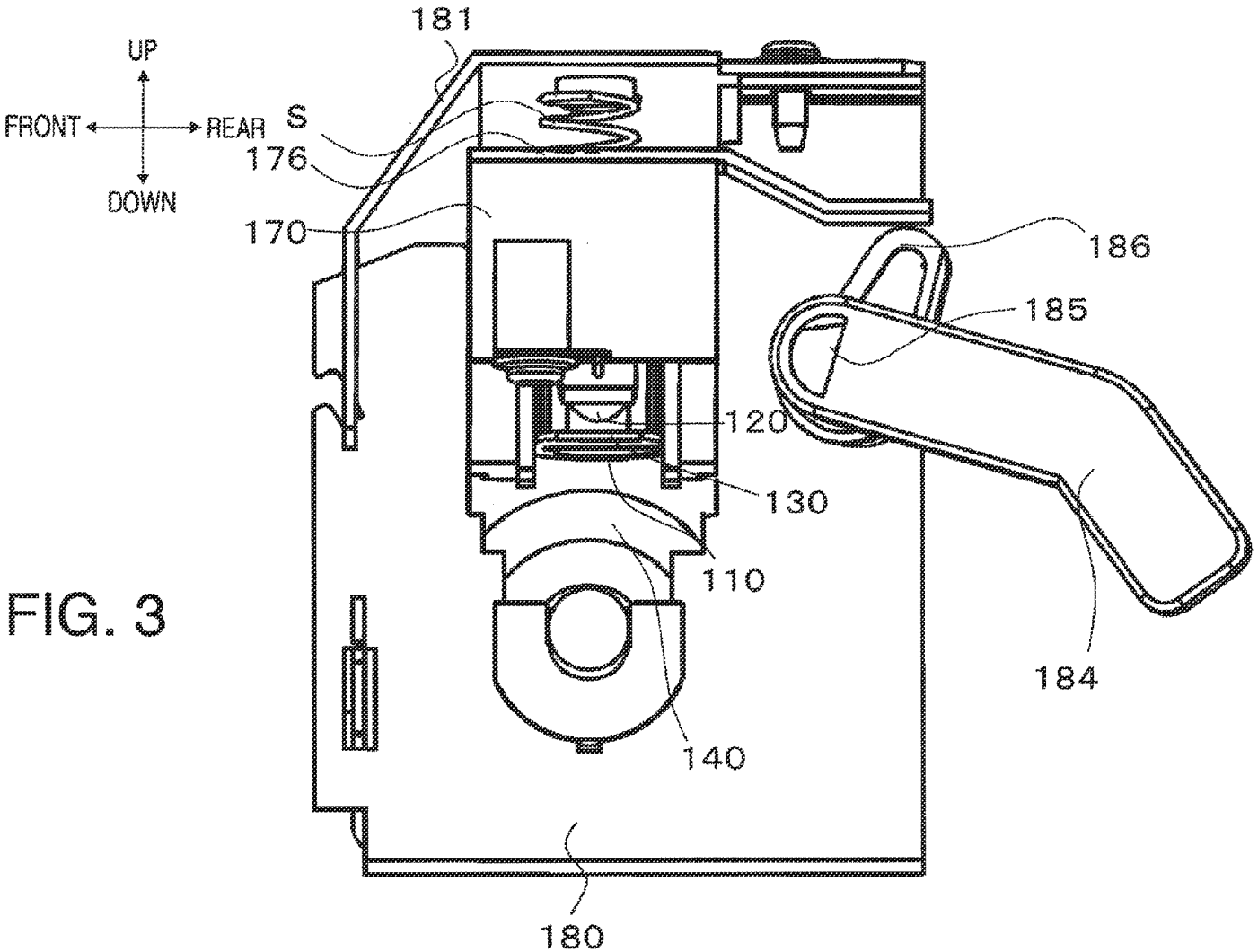
FIG. 3 is a right side view of the fixing unit, in which the nipping condition is cleared, in the printer according to the embodiment of the present invention.

The manipulation lever 184 is thus urged by the spring S via the stepped plate 176, the cam 186, and the rotation shaft 185 to trend toward a downward position (see FIG. 2) from an upward position (see FIG. 3). When the manipulation lever 184 is rotated upwardly (e.g., counterclockwise in FIG. 3) to uplift the stepped plate 176 via the cam 186, the guide plates 170 are uplifted along with the stepped plate 176 against the urging force of the expanding spring S. Accordingly, the nipping plate 130 can be separated from the pressure roller 140, or at least the nipping pressure between the nipping plate 130 and the pressure roller 140 is relaxed. Thus, nipping condition in the fixing unit 100 is relaxed. When the manipulation lever 184 is rotated downwardly (e.g., clockwise in FIG. 2) to the lower position, the cam 186 is released from the stepped plate 176. Accordingly, the guide plates 170 are shifted downwardly by the urging force of the spring S, and the nipping plate 130 and the pressure roller 140 are pressed to be in contact with each other. Thus, nipping condition is created in the fixing unit 100.

Main Frames and Linear Motion Cam

The manipulation lever 184 is moved by a linear motion cam 60 and a coupler assembly 80, which are supported by one (e.g., the right-side one) of the pair of main frames 50 (see FIG. 4). The linear motion cam 60 is a linearly-formed bar, which is arranged to extend substantially in parallel with a line connecting the front door 30 and the fixing unit 100. The linear motion cam 60 is movably supported by the main frame 50 to move linearly along the plane of the main frame 50 in the direction of depth of the printer 1. The linear motion cam 60 is arranged in the main frame 50 to penetrate the main frame 50 through an opening 50A (see FIG. 7) so that a front portion of the linear motion cam 60 closer to the front door 30 is disposed on a side (e.g., an outer side) opposite from the fixing unit 100 across the main frame 50 whilst a rear portion of the linear motion cam 60 closer to the fixing unit 100 is disposed on a same side (e.g., an inner side) as the fixing unit 100 (see FIGS. 4 and 7).

Figure 6:
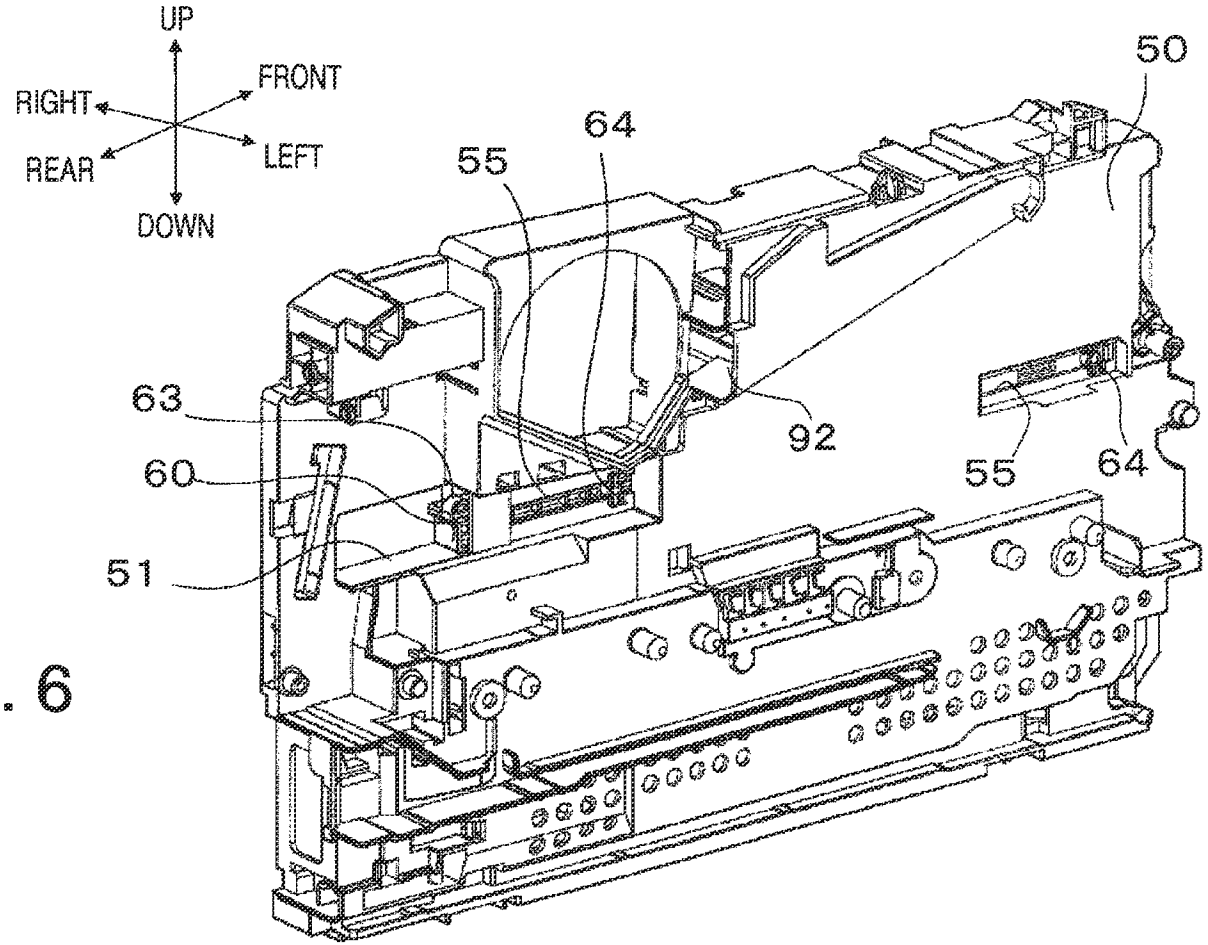
FIG. 6 is a perspective view of an inner side of the main frame of the printer according to the embodiment of the present invention.
Figure 7:
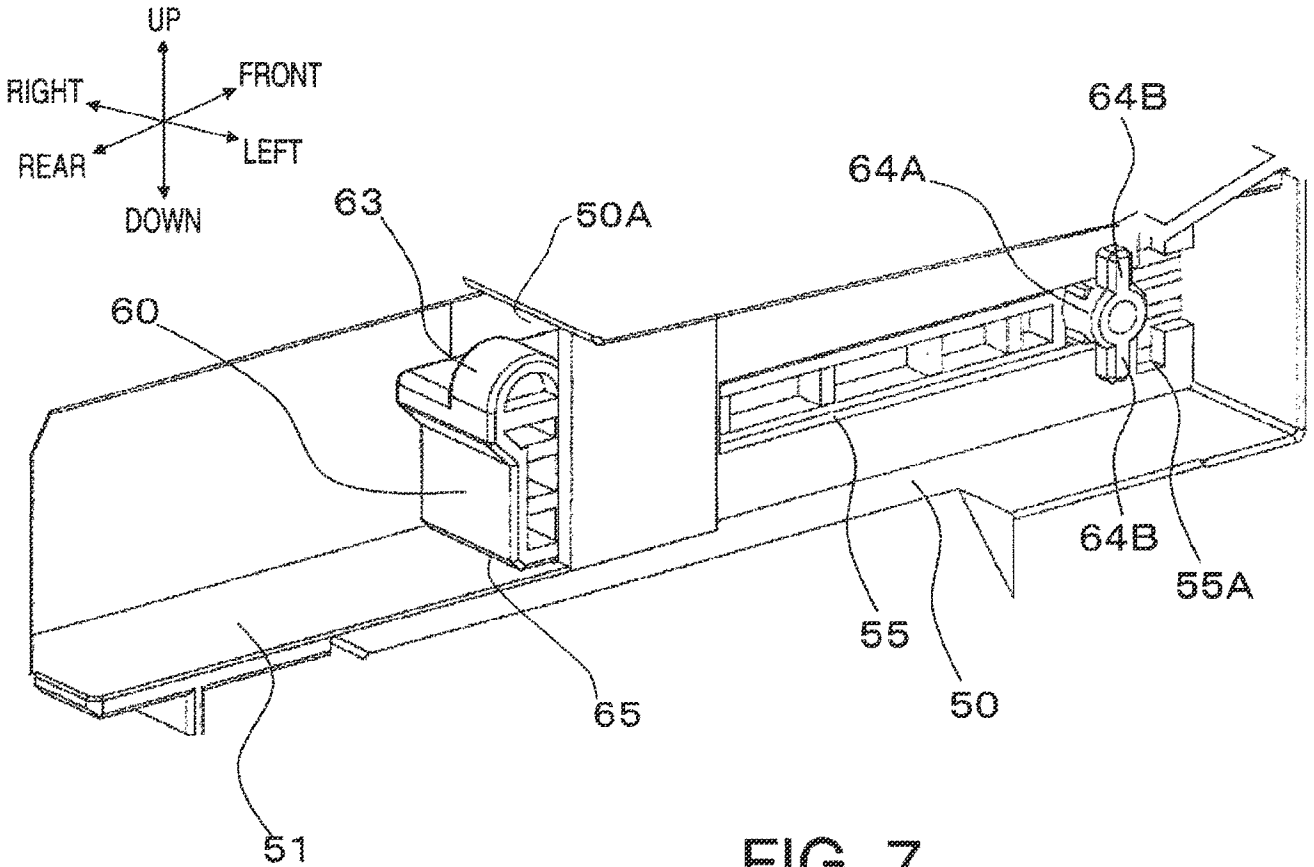
FIG. 7 is a partially enlarged perspective view of the main frame and the linear motion cam in the printer according to the embodiment of the present invention.

The linear motion cam 60 can be moved linearly by guiding members, which include slits 55 and a slider plane 51 (see FIGS. 6 and 7). The slits 55 are formed in the main frame 50 to linearly extend along the motion path of the linear cam 60. The slider plane 51 is formed in the main frame 50 to slidably support a lower surface 65 of the rear portion in the linear motion cam 60 closer to the fixing unit 100. The lower surface 65 is a bottom surface of the linear motion cam 60 on a side opposite from an axis side, which can face the rotation shaft 185 of the manipulation lever 184 as the linear motion cam 60 moves.

The linear motion cam 60 is made of resin, formed to have a shape of a rectangle in cross section, and provided with enhancing grid ribs. The linear motion cam 60 is provided with guide pieces 64, which are protrusions to be inserted in the slits 55 (see FIG. 7). Each guide piece 64 has a smaller cylinder portion 64A, of which height (diameter) is smaller than height of the slit 55, and a head portion 64B, of which height is greater than the height of the slit 55. Meanwhile, the slit 55 is formed to have an opening 55A, of which dimensions in height and in the front-rear direction are greater than those of the head portion 64B, on one end so that guide piece 64 can be inserted in the slit 55 by the head portion 64B through the opening 55A, and the smaller cylinder portion 64A can be slidably guided in the slit 55. The head portion 64B restricts the linear motion cam 60 from being separated from the main frame 50.

The slider plane 51 is formed to extend perpendicularly with respect to the surface of the vertically extending main frame 50 and slidably supports the lower surface 65 of the linear motion cam 60. The slider plane 51 is formed continuously from the surface of the main frame 50. Whilst two slits 55 and two guide pieces 64 are provided, one of the smaller cylinder portion 64A closer to the slider plane 51 does not contact a lower edge of the slit 55 when the linear motion cam 60 is attached to the main frame 50; therefore, the rear part of the linear motion cam 60 is supported not by the engagement of the head portion 64B and the slit 55 but by the slider plane 51. That is, whilst dimension in the right-left direction of inner edges of the slit 55 (i.e., thickness of the slit 55) is smaller than dimension in the right-left direction of the slider plane 51, the slit 55 closer to the slider plane 51 is prevented from being affected by the force transmitted from the manipulation lever 184. Meanwhile, the front portion of the linear motion cam 60 has the smaller cylinder portion 64A closer to the front door 30 to be in contact with the lower edge of the slit 55 so that the front portion of the linear motion cam 60 is supported by the slit 55.

Figure 8:
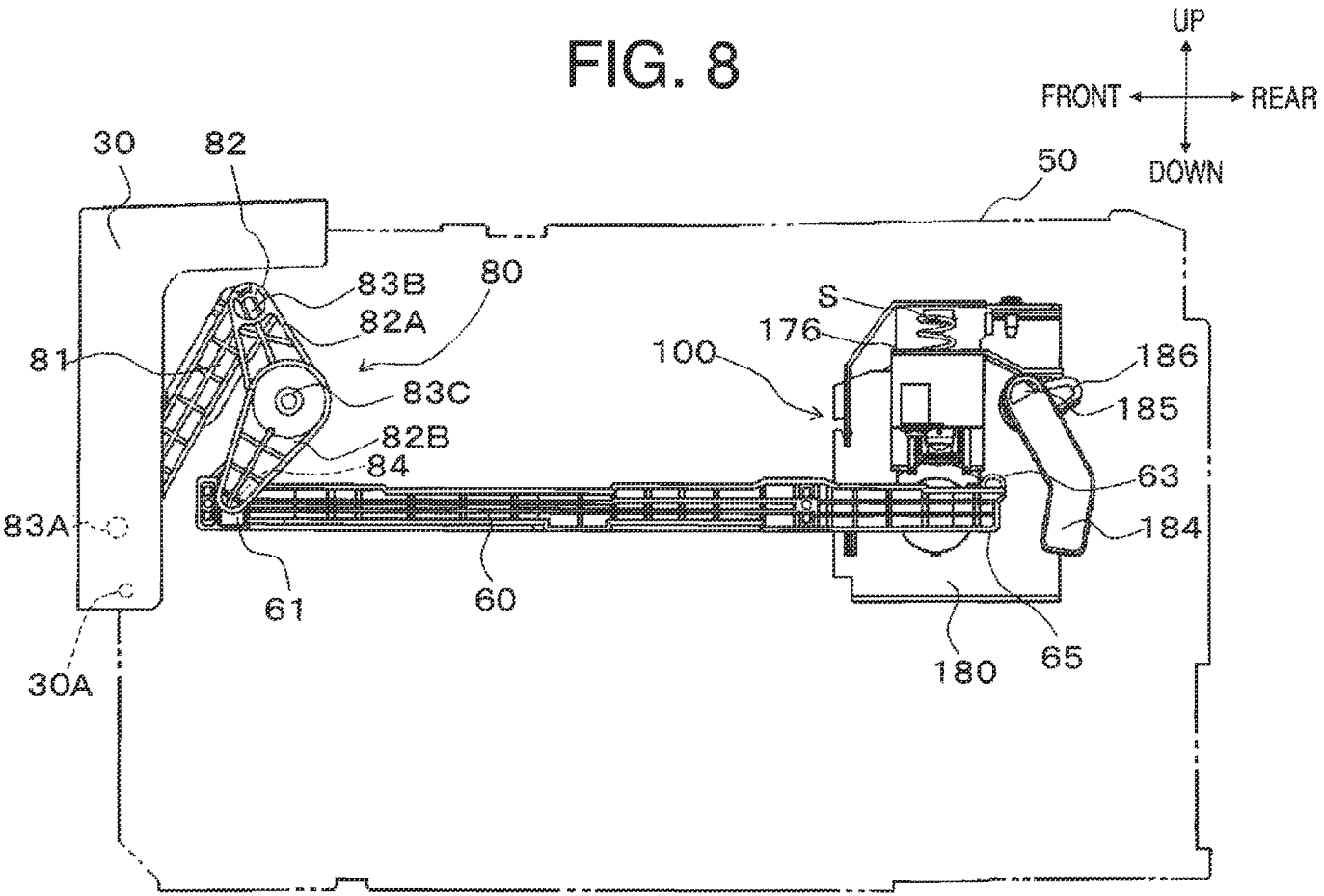
FIG. 8 is a side view of a front door, a link assembly, the linear motion cam, and the fixing unit in the printer according to the embodiment of the present invention.

The front door 30 and the linear motion cam 60 are coupled to each other via the coupler assembly 80 (see FIG. 8). The coupler assembly 80 includes a mutually connected first coupler 82 and a second coupler 81. The first coupler 82 includes two branched and mutually rotatably connected arms 82A, 82B, and a shaft 83C. The shaft 83C is fixed to an outer surface of the main frame 50, i.e., on the opposite side from the image forming unit 20 and the fixing unit 100 across the main frame 50. The arms 82A, 82B are rotatably connected to each other at the shaft 83C to rotate about the shaft 83C. The second coupler 81 is rotatably connected to the arm 82A of the first coupler 82 via a shaft 83B at one end and to the front door 30 via a shaft 83A at the other end. The arm 82B of the first coupler 82 is provided with a slidable shaft 84 on one end, which is not connected with the arm 82A, and the slidable shaft 84 is inserted in a groove 61, which is formed in a front end portion of the linear motion cam 60.

Figure 10:
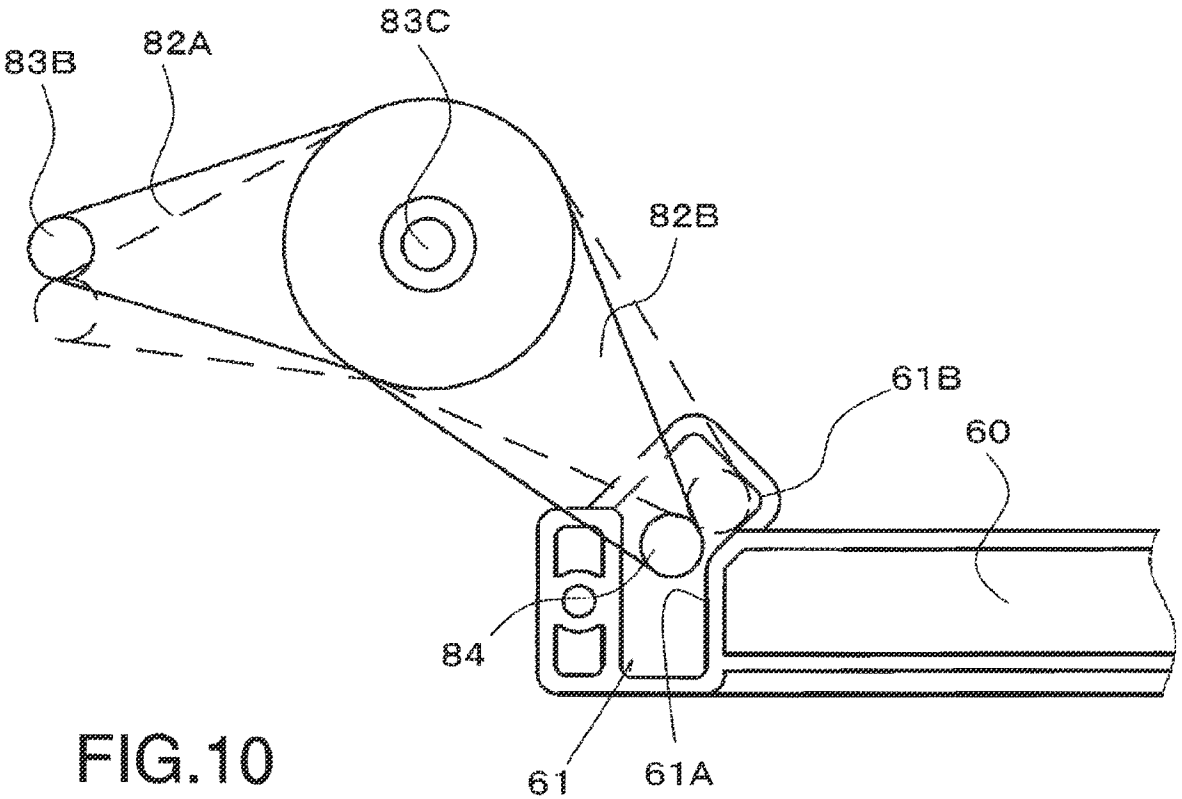
FIG. 10 is an enlarged partial view of the link assembly and the linear motion cam in the printer according to the embodiment of the present invention.

The groove 61 includes a first section 61A and a second section 61B (see FIG. 10). The first section 61 extends in a direction perpendicular with respect to the motion path of the linear motion cam 60 and in a direction to intersect with a rotating path of the arm 82B. The second section 61B extends from an upper end of the first section 61A in an inclined angle with respect to the first section 61A and in a direction to include the rotating path of the arm 82B.

Figure 9:
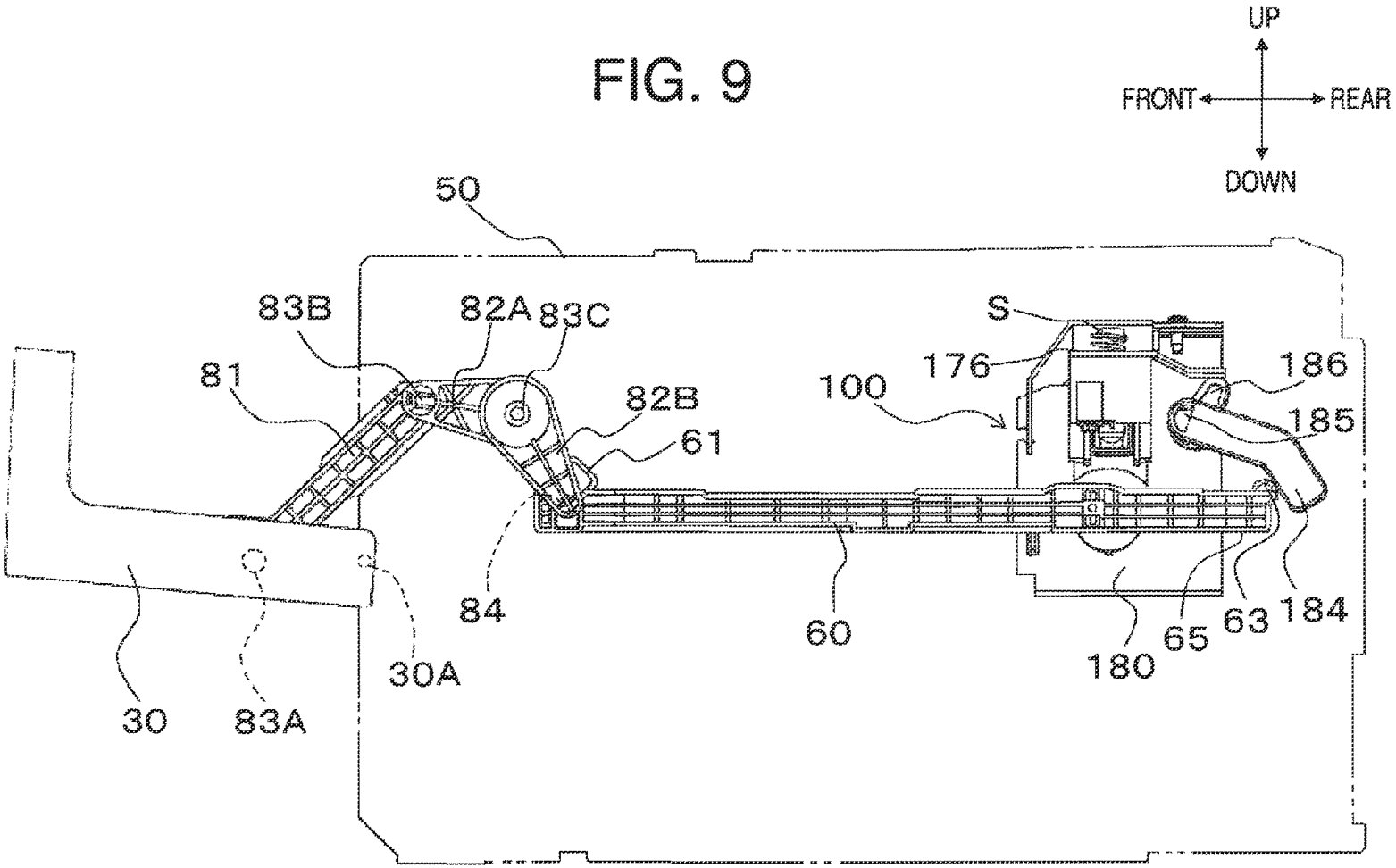
FIG. 9 is side view of the printer with the front door in an in-midst open position according to the embodiment of the present invention.

With the above coupler assembly 80, when the front door 30 is moved from a closed position (see FIG. 8) to an in-midst open position (see FIG. 9), the second coupler 81 rotates the first coupler 82 in a counterclockwise direction. Therefore, the slidable shaft 84 pushes the linear motion cam 60 rearward by the first section 61A. Once the linear motion cam 60 is shifted for a predetermined amount, i.e., once the nipping condition in the fixing unit 100 is relaxed or cleared, the slidable shaft 84 is moved in the second section 61B in the groove 61 (see a broken line in FIG. 10) and does not push the linear motion cam 60 further even if the front door is rotated further. Therefore, the front door 30 can be further rotated to a fully open position (not shown) to fully expose the front opening whilst the linear motion cam 60 is maintained unmoved. When the front door 30 is in the fully open position, for example, a most part of the front door 30 may be in a lower position with respect to the shaft 30A.

When the front door 30 is returned to the closed position, the second coupler 81 rotates the first coupler 82 in a clockwise direction. Therefore, the slidable shaft 84 is pulled frontward from the second section 61B to the first section 61A. When the slidable shaft 84 is pulled further, the linear motion cam 60 is shifted front ward.

Figure 5:
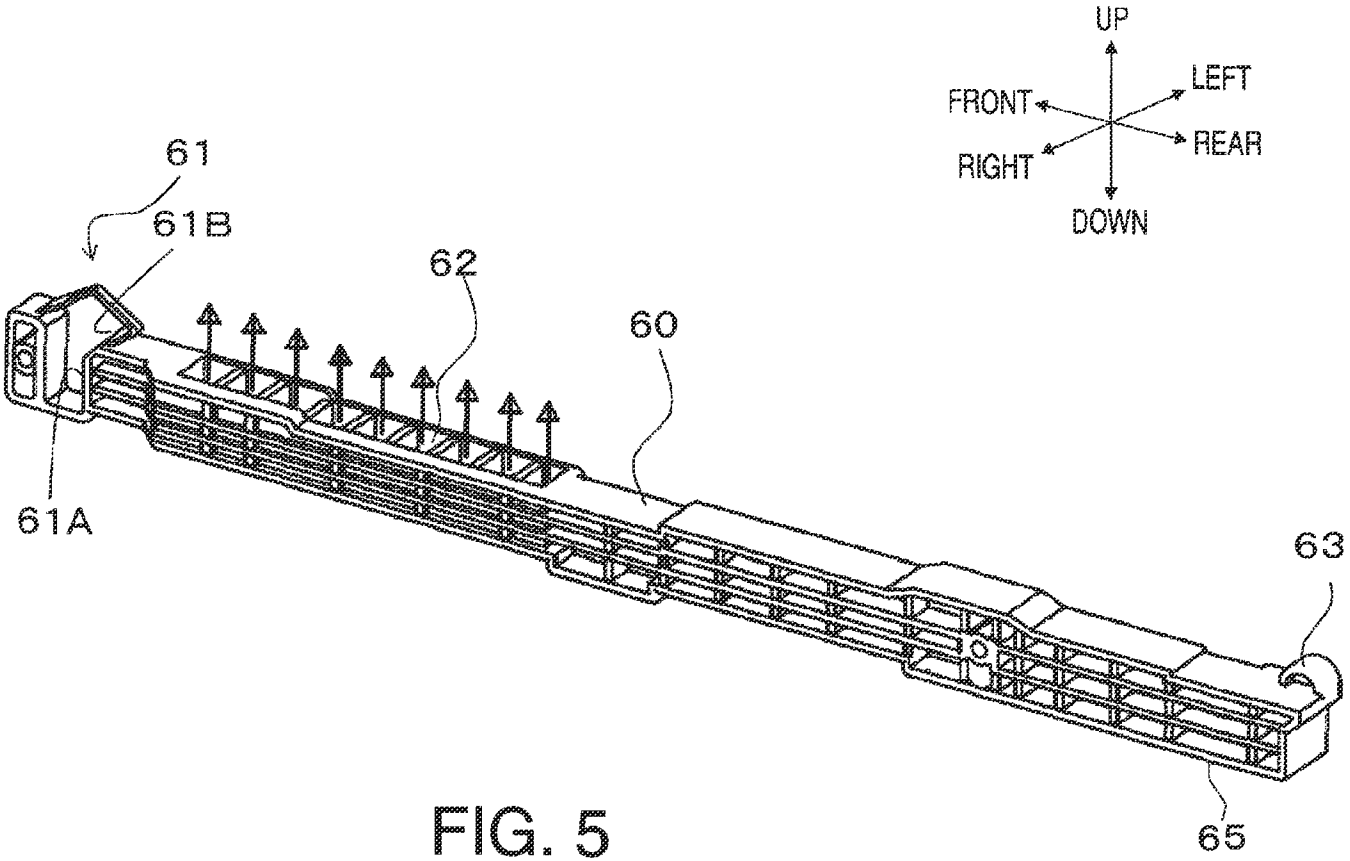
FIG. 5 is a perspective view of a linear motion cam in the printer according to the embodiment of the present invention.

The linear motion cam 60 is formed to have a contact projection 63 (see FIG. 5) on a rear end portion thereof. The contact projection 63 is a semicircular arc-shaped projection, which protrudes upward from an upper surface of the linear motion cam 60 and can become in contact with the manipulation lever 184 of the fixing unit 100. Whilst the manipulation lever 184 is rotatable about the shaft 185 being the rotation axis, the shaft 185 is in a position vertically separated from the linear motion path of the linear motion cam 60. The manipulation lever 184 extends downwardly but in a partially inclined angle with respect to the linear motion path of the linear motion cam 60. In particular, a lower portion of the manipulation lever 184 is bent inward with respect to an upper portion thereof when the manipulation lever 184 is in a downward orientation (see FIG. 8).

When the front door 30 is in the closed position (see FIG. 8), the linear motion cam 60 is in the front position with the contact projection 63 being apart from the manipulation lever 184. When the front door is rotated to open, the linear motion cam 60 is moved rearward to have the contact projection 63 in contact with the manipulation lever 184 (see FIG. 9). In this regard, until the contact projection 63 becomes in contact with the manipulation lever 184, the front door 30 is rotated without being affected by the urging force of the spring S in the fixing unit 100. Once the contact projection 63 contacts the manipulation lever 184, the front door 30 is rotated against the urging force of the spring S (see FIG. 9). Accordingly, the manipulation lever 184 is rotated by the contact projection 63 against the urging force of the spring S, and the nipping plate 130 is separated from the pressure roller 140.

In this regard, the manipulation lever 184 comes in contact with the contact projection 63 along an intersecting direction, which intersects with the linear motion path of the linear motion cam 60, and is pressed against the contact projection 63 in the intersecting direction to push the contact projection 63 toward lower front. Meanwhile, the linear motion cam 60 is in surface contact with the slider plane 51 at the lower surface 65 to be supported by the slider plane 51 of the main frame 50. Thus, the linear motion cam 60 can be securely supported by the slider plane 51, and the slider plane 51 can bear and absorb reaction force from the manipulation lever 184.

With the front door 30 being open, the user may access the processing cartridge 21 interposed between the main frames 50 through the front opening and remove the processing cartridge 21 therefrom. When the processing cartridge 21 is removed, the sheet conveyer path to the fixing unit 100 extending underneath the processing cartridge 21 (see FIG. 1) is exposed. With the front door 30 being open, the nipping pressure in the fixing unit 100 is cleared or at least relaxed, and the fixing unit 100 is placed in a nip-relaxed condition. Therefore, the recording sheet jammed in the sheet conveyer path can be smoothly removed.

Whilst the fixing unit 100 is in the nip-relaxed condition, the manipulation lever 184 affected by the urging force of the spring S tends to rotate clockwise (see FIG. 9) against the linear motion cam 60. Once the front door 30 is rotated to return in the closed position (see FIG. 8), the manipulation lever 184 is released from the linear motion cam 60 and moved to the downward position, in which the spring S is not restricted by the manipulation lever 184 but allowed to transmit the urging force to the stepped plate 176. Therefore, the fixing film 110 and the pressure roller 140 are in the nipping position in the fixing unit 100. In this regard, as the manipulation lever 184 rotates clockwise, the manipulation lever 184 pushes the linear motion cam 60 frontward to assist the front door 30 to return in the closed position.

In the printer 1, in a position opposite from the image forming unit 20 across one of the main frames 50 (e.g., the main frame 50 on the right), i.e., between one of the main frames 50 and a lateral side of the main casing 2, a low-voltage power board 70 and a shield box 71, which accommodates the power board 70, are arranged (see FIG. 4). The power board 70 and the shield box 71 are arranged in lower positions with respect to the linear motion cam 60.

The shield box 71 is made of, for example, metal for isolation from electromagnetic waves and effective heat radiation. The shield box 71 is formed to have vents 52A, 52B, 53 on a front side, a rear side, and an upper side thereof.

The power board 70 has a heat sink 73, on which a heat-producing circuit element 72 is mounted. The heat sink 73 is made of a heat-conductive material (e.g., aluminum) and attached to the shield box 71 to be in heat-conductively contact with the upper surface of the shield box 71.

The linear motion cam 60 linearly-movably extending in the position above the shield box 71 is formed to have vents 62 (see FIG. 5) in positions to vertically coincide with the vents 53 of the shield box 71 when the front door 30 is in the closed position. The vents 52 are formed to penetrate the linear motion cam 60 along the extending direction of the main frames 50, i.e., along the direction of height of the main frames 50, and openings of the vents 62 align on a plane, which extends in the direction of depth of the printer 1 in parallel with the motion path of the linear motion cam 60 and perpendicularly to the main frames 50.

The main frame 50 is further provided with an exhaust fan 90 in an upper position with respect to the linear motion cam 60. The heated air surrounding the fixing unit 100 is evacuated out of the printer 1 by the exhaust fan 90 through an outlet (not shown) formed in the lateral side wall of the main casing 2, which faces the main frame 50 with the exhaust fan 90.

The main frame 50 is further formed to have a vent 92 (see FIG. 6), which penetrates the main frame 50 along the direction of depth of the printer 1. The exhaust fan 90 draws the air in the upper area above the vents 62 of the linear motion cam 60 to the inner area inside the main frame 50, in which the fixing unit 100 is arranged, and directs the in-drawn air along with the air surrounding the fixing unit 100 outside the main casing 2. Therefore, as indicated by arrows 91A, 91B in FIG. 4, the air drawn in the shield box 71 through the vents 52A, 52B is directed to the upper area above the vents 62 of the linear motion cam 60. Further, as indicated by an arrow 91D, the air is directed to the inner side of the frame 50 through the vent 92 and evacuated outside the main frame 50 and the main casing 2. In this regard, as the air surrounding the shield box 71 heated by the heat sink 73 is evacuated, the shield box 71 is cooled by the air drawn through the vents 52A, 52B.

Thus, even when the main frames 50 are arranged in the vicinities of the lateral walls of the main casing 2 in the printer 1, in which the linear motion cam 60 may otherwise block the airflow between the power board 70 and the exhaust fan 90, with the vents 62 formed in the linear motion cam 60, the airflow between the power board 70 and the exhaust fan 90 can be secured. Therefore, the circuit element can be effectively cooled.

Effects

According to the above printer 1, the linear motion cam 60 is moved to clear or relax the nipping condition in the fixing unit 100 in cooperation with the opening motion of the front door 30. Thus, the sheet jammed in the sheet conveyer path can be removed easily when the front door 30 is opened and the processing cartridge 21 is removed. The front door 30 is rotatably attached to the main frames 50 via the coupler assembly 80, which is arranged on the outer side of the main frame 50 being the opposite side from the processing cartridge 21 across the main frames 50. In other words, an area, in which exchange of the processing cartridge 21 and removal of the jammed recording sheet take place, is not occupied by the linear motion cam 60 or the coupler assembly 80. Therefore, exchange of the processing cartridge 21 and removal of the jammed recording sheet can be conducted smoothly without being interfered with by the linear motion cam 60 or the coupler assembly 80.

According to the above-described configuration, the coupler assembly 81 is provided with the two-parted first coupler 82, which includes the arms 82A, 82B, and the second coupler 81, which connects the arm 82A to the front door 30. Meanwhile, the arm 82B of the first coupler 82 is connected with the linear motion cam 60. Thus, the linear motion cam 60 can be shifted linearly by the opening motion of the front door 30 due to the movement of the coupler assembly 80. Further, the rotation of slidable shaft 84 of the arm 82B can push the inner edge of the first section 61A of the groove 61, which extends in the intersecting direction with the rotation path of the slidable shaft 84, so that the linear motion cam 60 can be moved linearly.

According to the above-described configuration, as the front door 30 rotates in the range between the in-midst open position and the closed position, the linear motion cam 60 is moved by the slidable shaft 84 pressing the inner edge of the first section 61A of the groove 61. When the front door 30 rotates further beyond the in-midst open position, the slidable shaft 84 is released in the inclined second section 61B of the groove 61 and moves there-along without further moving the linear motion cam 60. Therefore, the linear motion cam 60 is maintained at the position corresponding to the in-midst open position of the front door 30 even when the front door 30 rotates further to the fully open position. Further, whilst the rotating motion of the slidable shaft 84 is absorbed in the second section 61B, the linear motion cam 60 is prevented from being affected by excessive load from the front door 30 and the coupler assembly 80.

According to the above-described configuration, the linear motion cam 60 is movably supported by the guiding members in the main frame 50. Whilst the front door 30 is rotatably movable, the linear motion cam 60 is linearly movable without rotating or swinging within the main frame 50. In other words, the linear motion cam 60 requires smaller space in the main frame 50 to move. Therefore, the front door 30 and the fixing unit 100 can be coupled space-efficiently whilst a size of the printer 1 can be maintained to be smaller.

When the fixing unit 100 is in the nip-relaxed condition, the manipulation lever 184 tends to rotate against the linear motion cam 60 in the direction to reach and intersect with the moving path of the linear motion cam 60. In this regard, the pressure from the spring S via the manipulation lever 184 is applied to the contact projection 63 and is received by the slider plane 51 of the main frame 50, which is in surface contact with the lower surface 65 of the linear motion cam 60, so that the linear motion cam 60 can bear and absorb the reaction force from the manipulation lever 184 without being deformed to move steadily in the main frame 50.

According to the above-described configuration, when the front door 30 is in the closed position, the manipulation lever 184 is in the position apart from the linear motion path of the linear motion cam 60 and extends downwardly in a partially inclined angle with respect to the motion path of the linear motion cam 60. Thus, the manipulation lever 184 is in contact with the linear motion cam 60 in the inclined angle and tends to move the linear motion cam 60 by the rotation. Due to the inclination, the force from the manipulation lever 184 can be securely absorbed by the slider plane 51 of the guiding member via the linear motion cam 60.

According to the above-described configuration, the linear motion cam 60 presses the manipulation lever 184 against the pressure from the spring S to nip the recording sheet in the fixing unit 100. In other words, rotation of the front door 30, rearward motion of the linear motion cam 60, and the manipulation lever 184 to be pressed are interrelated, and the load from the spring S to nip the recording sheet can be easily relaxed or cleared by the simple rotating motion of the front door 30. Further, when the front door 30 is in the closed position, the linear motion cam 60 and the manipulation lever 184 are in the separate positions to be apart from each other. That is, when the front door 30 is in the closed position, the force from the spring S is not transmitted to the front door 30. Therefore, the front door 30 can be easily and smoothly rotated without being affected by the force from the spring S when the front door 30 starts to be rotated.

According to the above-described configuration, the slider plane 51 and the slits 55 formed in the main frame 50 serve as guiding members, which hold the linear motion cam 60 slidably in the main frame 50. The slider plane 51 is formed in the vicinity of the fixing unit 100 and bears the load from the coupler assembly 80, which can relax or clear the nipping pressure in the fixing unit 100. Meanwhile, the front portion of the linear motion cam 60 closer to the front door with respect to the slider plane 51 is supported by one of the slits 55. Thus, the linear motion cam 60 can be supported in the front portion and the rear portion thereof in balanced condition.

More Examples

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 11:
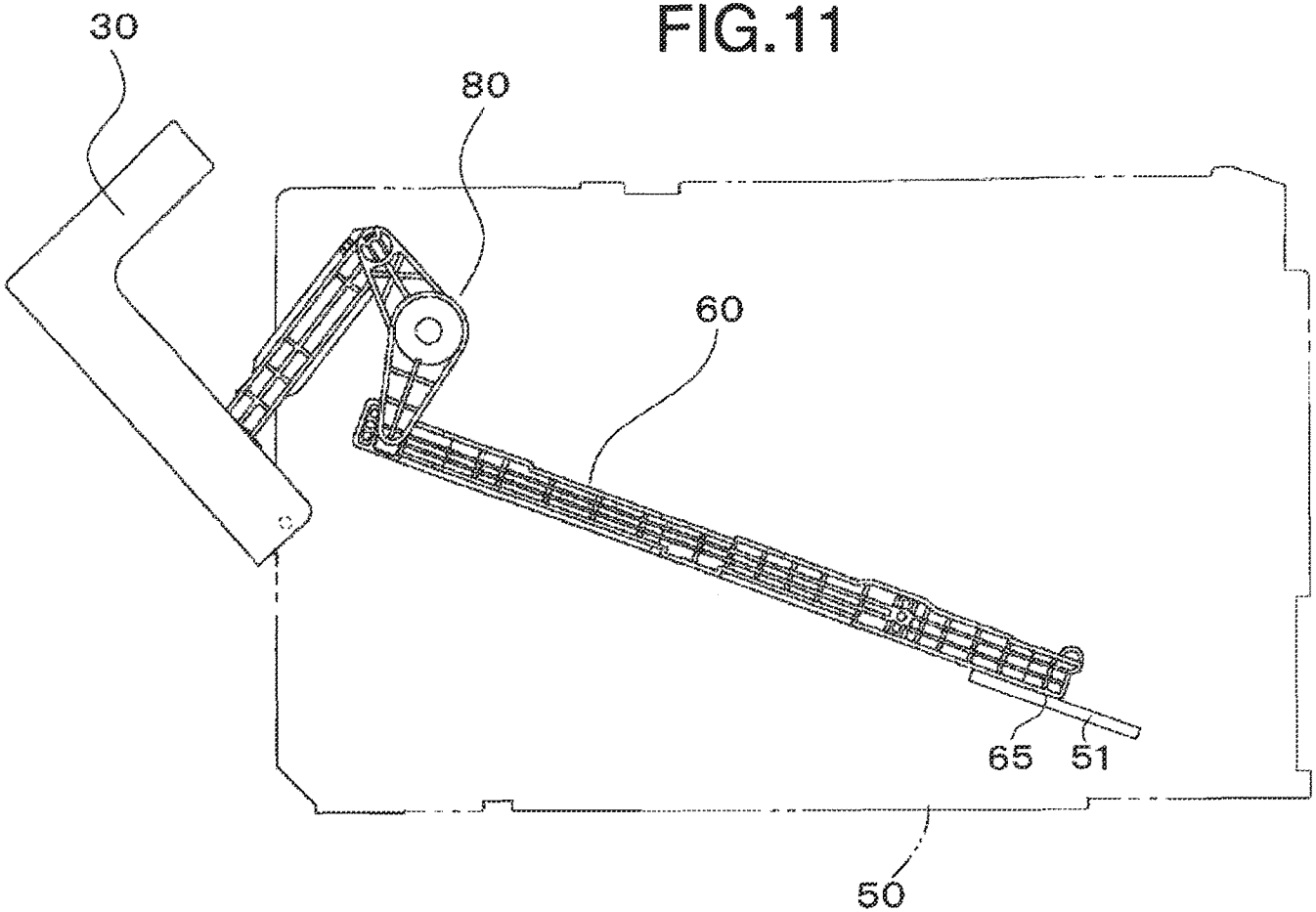
FIG. 11 is a side view of a front door, a link assembly, the linear motion cam, and the fixing unit in a printer according to a different example of the present invention.

For example, the linear motion cam 60 may be installed in the printer 1 in an inclined orientation (see FIG. 11) to move linearly along an inclined direction with respect to a horizontal plane. Alternatively, the linear motion cam 60 may be moved linearly along a vertical direction. In any way, a surface of the linear motion cam 60 opposite from the portion which becomes in contact with the manipulation lever 184 is received by the slider plane 51 of the main frame 50.

Figure 12:
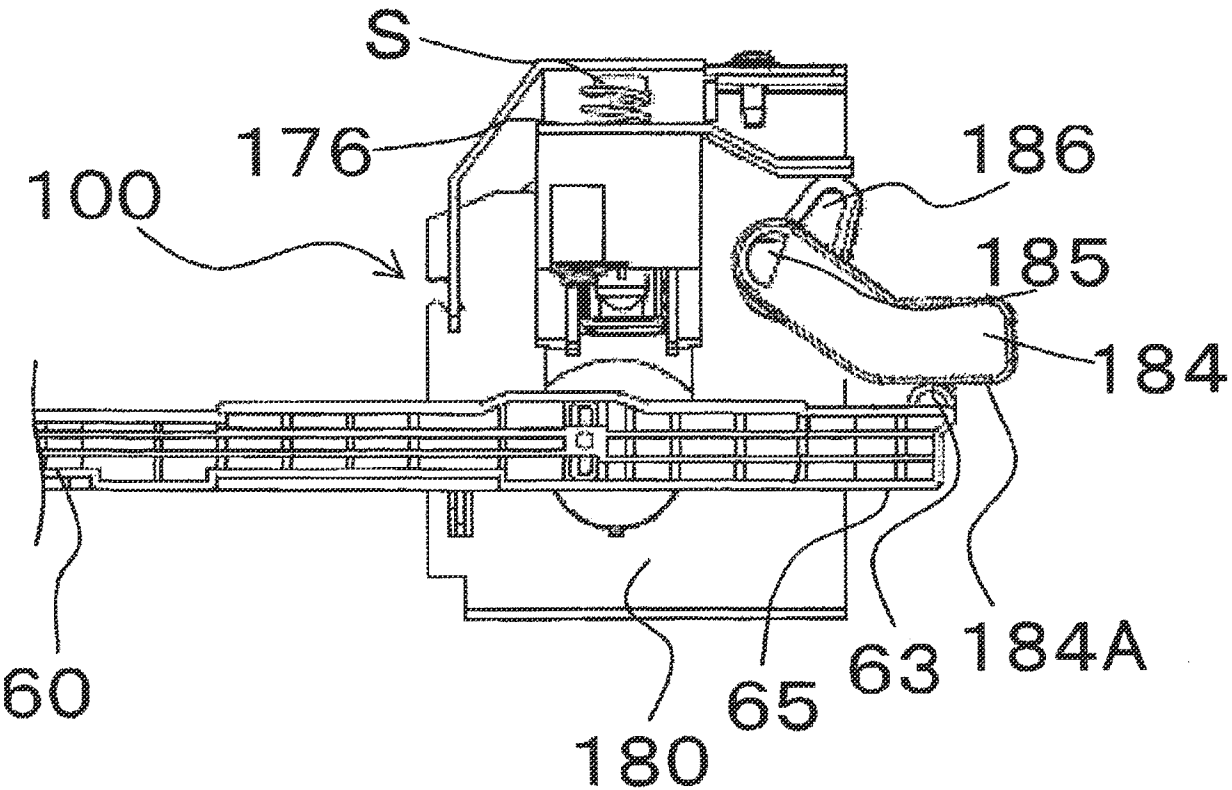
FIG. 12 is a side view of a front door, a link assembly, the linear motion cam, and the fixing unit in the printer according to another different embodiment of the present invention.
Figure 13:
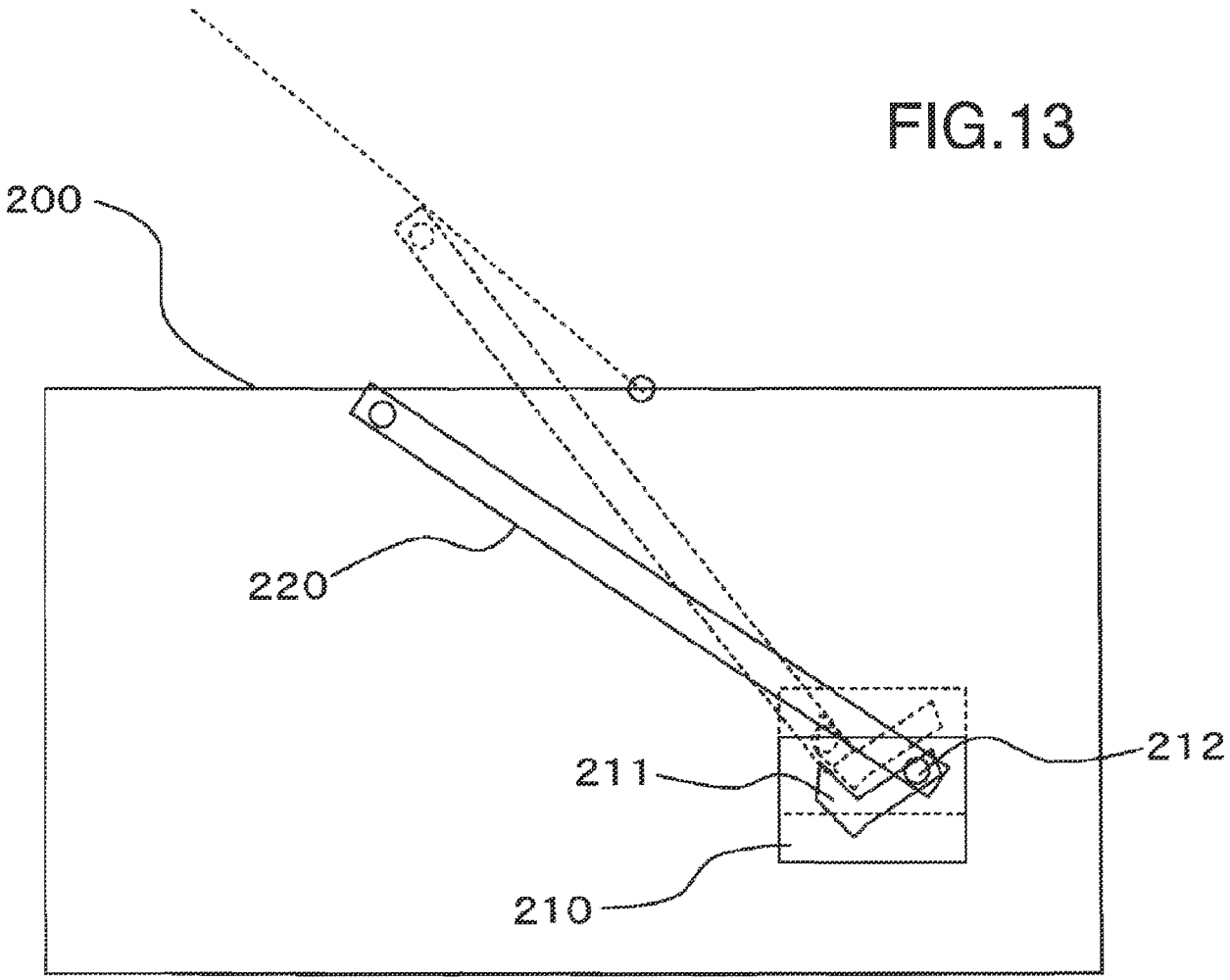
FIG. 13 illustrates the nip-relaxing system of a conventional image forming apparatus.

For another example, the manipulation lever 184 may be have an angled shape, in which a lower portion 184A thereof is bent outward with respect to the upper portion thereof (see FIG. 12), so that the manipulation lever 184 rotated by the linear motion cam 60 is moved to an orientation to have an edge of the lower portion 184A in parallel with the linear motion path of the linear motion cam 60. With the manipulation lever 184 being bent outwardly at the lower portion 184A, the vertical position of the lower portion 184A can be maintained, and the linear motion cam 60 is allowed to move beyond the manipulation lever 184 even when the linear motion cam 60 is movable for a larger linear amount with respect an amount of the manipulation lever 184 to be moved to relax or clear the nipped condition in the fixing unit 100. When the manipulation lever 184 is in the orientation, in which the edge of the lower portion 184A aligns in parallel with the linear motion path of the linear motion cam 60, the force from the spring S is transmitted to the cam 186, which therefore presses the manipulation lever 184 against the linear motion cam 60. When the front door 30 is rotated to the closed position and the linear motion cam 60 is pulled frontward, the manipulation lever 184 is allowed to rotate in the clockwise direction so that the nipping condition is recreated in the fixing unit 100.

For another example, in the above embodiment, the slidable shaft 84 is provided to the coupler assembly 80, whilst the groove 61 is formed in the linear motion cam 60. However, the coupler assembly 80 may be provided with a groove, and the linear motion cam 60 may be formed to have a slidable shaft. Further, the slits 55 may be formed in the linear motion cam 60 instead of in the main frame 50, whilst the guide pieces 64 may be formed in the main frame 50.

Further, an electric circuit board and other heat-generating devices may be arranged in the lower position with respect to the linear motion cam 60 in addition to the low-voltage power board 70 and the shield 71.

What is claimed is:

1. An image forming apparatus, comprising:

a casing having an opening;

an image forming unit disposed in the casing and configured to form an image on a sheet;

a door coupled to the casing via a hinge and configured to move between a closed position in which the door covers the opening and an opened position in which the door does not cover the opening;

a pushing rod constrained to move in a linear direction;

a link mechanism comprising:

a link rod;

a coupler including:

a first arm, and a second arm, such that the coupler is rotatable about an axis;

wherein the link rod couples the door and the first arm of the coupler;

wherein the second arm of the coupler is coupled with the pushing rod, and wherein, when the door is moved from the closed position toward the opened position, (1) the link rod is pulled by the door, (2) the first arm of the coupler is pulled by the link rod, (3) the coupler rotates about the axis, (4) the second arm of the coupler pushes the pushing rod, and (5) the pushing rod moves closer to the image forming unit along the linear direction, and wherein, when the door is moved from the opened position toward the closed position, (1) the link rod is pushed by the door, (2) the first arm of the coupler is pushed by the link rod, (3) the coupler rotates about the axis, (4) the second arm of the coupler pulls the pushing rod, and (5) the pushing rod moves away from the image forming unit along the linear direction.

2. The image forming apparatus according to the claim 1, wherein the image forming unit comprises a fixing unit configured to heat the sheet for fixing the image on the sheet, wherein the fixing unit includes an arm, wherein the pushing rod pushes the arm of the fixing unit when the door is in the opened position, and wherein the pushing rod does not push the arm of the fixing unit when the door is in the closed position.

3. The image forming apparatus according to the claim 2, wherein the image forming unit is configured to form a toner image on a sheet, wherein the fixing unit is configured to nip the sheet with the toner image formed thereon by applying nipping pressure and fix the toner image on the sheet, wherein, when the door is in the closed position and the pushing rod does not push the arm, the fixing unit is in a nipping condition, in which the sheet is nipped by the nipping pressure in the fixing unit, and wherein, when the door is in the opened position and the pushing rod pushes the arm, the fixing unit is in a nip-relaxed condition, in which the nipping pressure is relaxed in the fixing unit.

4. The image forming apparatus according to the claim 1, wherein the pushing rod has a vent configured to allow an air flow across the linear direction.

5. The image forming apparatus according to the claim 3, wherein the image forming unit further comprises a cartridge configured to store toner, and wherein the cartridge is replaceable through the opening when the door is in the opened position.

6. The image forming apparatus according to the claim 1, further comprising:

a guiding member configured to guide the pushing rod so that the pushing rod moves in the linear direction.

7. An image forming apparatus, comprising:

a casing having an opening;

an image forming unit disposed in the casing and configured to form an image on a sheet;

a door coupled to the casing via a hinge and configured to move between a closed position in which the door covers the opening and an opened position in which the door does not cover the opening;

a pushing rod;

a guiding member configured to guide the pushing rod so that the pushing rod moves in a linear direction;

a link mechanism coupled to the door and to the pushing rod;

wherein, when the door is moved from the closed position toward the opened position, the link mechanism urges the pushing rod toward the image forming unit along the linear direction, wherein, when the door is moved from the opened position toward the closed position, the link mechanism urges the pushing rod away from the image forming unit along the linear direction, and wherein the link mechanism includes a link rod and a coupler having a first arm and a second arm such that the coupler is rotatable about an axis.

8. The image forming apparatus according to claim 7, wherein, when the door is moved from the closed position toward the opened position, the link mechanism urges the pushing rod toward the image forming unit along the linear direction by:

(1) the link rod being pulled by the door, (2) the first arm of the coupler being pulled by the link rod, (3) the coupler rotating about the axis, (4) the second arm of the coupler pushing the pushing rod, and wherein, when the door is moved from the opened position toward the closed position, the link mechanism urges the pushing rod away from the image forming unit along the linear direction by:

(1) the link rod being pushed by the door, (2) the first arm of the coupler being pushed by the link rod, (3) the coupler rotating about the axis, (4) the second arm of the coupler pulling the pushing rod.

9. The image forming apparatus according to the claim 7, wherein the image forming unit comprises a fixing unit configured to heat the sheet for fixing the image on the sheet, wherein the fixing unit includes an arm, wherein the pushing rod pushes the arm of the fixing unit when the door is in the opened position, and wherein the pushing rod does not push the arm of the fixing unit when the door is in the closed position.

10. The image forming apparatus according to the claim 9, wherein the image forming unit is configured to form a toner image on a sheet, wherein the fixing unit is configured to nip the sheet with the toner image formed thereon by applying nipping pressure and fix the toner image on the sheet, wherein, when the door is in the closed position and the pushing rod does not push the arm, the fixing unit is in a nipping condition, in which the sheet is nipped by the nipping pressure in the fixing unit, and wherein, when the door is in the opened position and the pushing rod pushes the arm, the fixing unit is in a nip-relaxed condition, in which the nipping pressure is relaxed in the fixing unit.

11. The image forming apparatus according to the claim 7, wherein the pushing rod has a vent configured to allow an air flow across the linear direction.

12. The image forming apparatus according to the claim 8, wherein the image forming unit further comprising a cartridge configured to store toner, and wherein the cartridge is replaceable through the opening when the door is in the opened position.

13. An image forming apparatus, comprising:

a chassis having an opening;

an image forming unit, which is configured to form a toner image on a recording sheet;

a door, which is disposed at the opening of the chassis and configured to be movable in a range between an open position and a closed position with respect to the chassis;

a linear motion member that is confined to move linearly along a motion path; and a coupler assembly, which is configured to couple the door with the linear motion member and move the linear motion member in the motion path according to opening and closing motions of the door, the coupler assembly including a link rod and a coupler having a first arm and a second arm and being pivotable about an axis, the link rod being coupled to the first arm and the linear motion member being coupled to the second arm, wherein, when the door is moving toward the open position, the door pulls on the link rod, the coupler pivots about the axis, and the linear motion member moves away from the door, and wherein, when the door is moving toward the closed position, the door pushes on the link rod, the coupler pivots about the axis, and the linear motion member moves toward the door.

14. The image forming apparatus according to claim 13, further comprising:

a fixing unit located in the chassis spaced apart from the door, wherein movement of the linear motion member changes a nipping state in the fixing unit.

15. The image forming apparatus according to claim 13, further comprising:

a guiding member that restricts non-linear movement of the linear motion member while permitting linear movement of the linear motion member.

16. The image forming apparatus according to claim 15, wherein the guiding member further includes a slit formed to extend along the motion path of the linear motion member, and wherein the slit is located in a vicinity of one end of the linear motion member closer to the coupler assembly.

17. The image forming apparatus according to claim 15, wherein the linear motion member further comprises a slit formed therein, wherein the guiding member further includes a protrusion to be inserted in the slit in the linear motion member, and wherein the protrusion is located in a vicinity of one end of the linear motion member closer to the coupler assembly.

18. The image forming apparatus according to claim 14, wherein the linear motion member further including a vent formed therein, the vent penetrating the linear motion member and has an opening on a plane extending in parallel with the motion path and horizontally.

19. The image forming apparatus according to claim 14, wherein the fixing unit is in a nipping position when the door is in the closed position, and wherein the fixing unit is in a nip-relaxed condition when the door is in the open position.

20. An image forming apparatus, comprising:

an image forming unit, which is configured to form a toner image on a recording sheet;

a fixing unit, which is configured to nip the recording sheet with the toner image by nipping pressure and fix the toner image on the recording sheet;

frames including a first frame and a second frame, which are arranged to have the image forming unit and the fixing unit in internal space there between;

a door, which is configured to cover an opening, the opening being connected with one side of the internal space between the first frame and the second frame, the one side being an opposite side from the fixing unit across the image forming unit;

a linear motion member, which is configured to move linearly along a motion path along a line connecting the door and the fixing unit; and a coupler assembly, which is configured to couple the door with the linear motion member and move the linear motion member in the motion path in cooperation with opening and closing motions of the door, wherein the coupler assembly includes a link rod and a coupler having a first arm and a second arm and being pivotable about an axis, the link rod being coupled to the first arm and the linear motion member being coupled to the second arm, wherein, when the door is opening, the door pulls on the link rod, the coupler pivots about the axis, and the linear motion member moves away from the door, and wherein, when the door is closing, the door pushes on the link rod, the coupler pivots about the axis, and the linear motion member moves toward the door.

21. The image forming apparatus according to claim 20, wherein the image forming unit is removably installable in the internal space through the opening, and wherein a sheet conveyer path to convey the recording sheet to the fixing unit is exposed through the opening when the door is in the open position and the image forming unit is removed from the internal space.

22. The image forming apparatus according to claim 20, wherein one of the linear motion member and the second arm is formed to have a slidable shaft, wherein the other of the linear motion member and the second arm is formed to have a groove, wherein the linear motion member and the second arm are connected with each other via the slidable shaft and the groove, and wherein the groove is positioned to extend at least partially along a direction to intersect with a rotation path of the second arm.

23. The image forming apparatus according to claim 22, wherein the groove is formed to have a first section, which extends along the direction to intersect with the rotation path of the second arm, and a second section, which extends from an end of the first section along the rotation path of the second arm.

24. The image forming apparatus according to claim 20, further comprising:

a guiding member, which is formed in the first frame and configured to guide the linear motion member to move linearly in the motion path.

25. The image forming apparatus according to claim 24, wherein the guiding member further includes a slit formed to extend along the motion path of the linear motion member, and wherein the slit is located in a vicinity of one end of the linear motion member closer to the coupler assembly.

26. The image forming apparatus according to claim 24, wherein the linear motion member further comprises a slit formed therein, wherein the guiding member further includes a protrusion to be inserted in the slit in the linear motion member, and wherein the protrusion is located in a vicinity of one end of the linear motion member closer to the coupler assembly.

27. The image forming apparatus according to claim 20, further comprising a manipulation member, which is movable according to the linear motion of the linear motion member and is configured to place the fixing unit in one of a nipping condition, in which the recording sheet is nipped by the nipping pressure in the fixing unit, and a nip-relaxed condition, in which nipping pressure is relaxed in the fixing unit, wherein the image forming unit and the fixing unit are arranged on a first side of the first frame, and the coupler assembly is arranged on a second side of the first frame, and wherein the linear motion member is supported by the first frame to penetrate the first frame through an opening formed in the first frame to have one end of the linear motion member closer to the manipulation member disposed on the first side of the first frame and another end of the linear motion member closer to the coupler assembly disposed on the second side of the first frame.

28. The image forming apparatus according to claim 20, wherein the linear motion member is formed to have a vent, which penetrates the linear motion member along a direction in parallel with the first frame and has an opening on a plane of extending in parallel with the motion path and perpendicularly to the first frame.

29. The image forming apparatus according to claim 20, wherein the fixing unit is in a nipping condition when the door closed, and wherein the fixing unit is in a nip-relaxed condition when the door is opened.

* * * * *

UNITED STATES PATENT AND TRADEMARK OFFICE

CERTIFICATE OF CORRECTION

PATENT NO. : 8,693,918 B2
APPLICATION NO. : 13/942788
DATED : April 8, 2014
INVENTOR(S) : Takashi Hoshino It is certified that error appears in the above-identified patent and that said Letters Patent is hereby corrected as shown below:

On the Title Page, (71) under "Applicant," please delete, "Brother Kogyo Kabushiki Kaisha, Aichi (JP)" and replace with --Takashi Hoshino--.

Signed and Sealed this
Thirty-first Day of March, 2015

Michelle K. Lee

Michelle K. Lee
*Director of the United States Patent and Trademark Office*